US006088858A

United States Patent [19]

Juster et al.

[11] Patent Number: 6,088,858

[45] Date of Patent: Jul. 18, 2000

[54] MATTRESS JACKET WITH AN ACCESSIBLE AND EXPANDABLE COMPARTMENT

[76] Inventors: Robert W. Juster, 6225 Reserve Cir. #1103, Naples, Fla. 34119; James W. Carpenter, Jr., 815 Farwell Dr., Maple Bluff, Wis. 53704

[21] Appl. No.: 09/238,798

[22] Filed: Jan. 29, 1999

[51] Int. Cl.[7] ..... A47G 9/04

[52] U.S. Cl. ..... 5/737; 5/496; 5/498; 5/500; 5/502; 5/691; 5/693; 5/727; 5/906

[58] Field of Search ..... 5/737, 738, 691, 5/693, 727, 728, 906, 486, 496, 497, 498, 499, 500, 502

[56] References Cited

U.S. PATENT DOCUMENTS

| | | | |
|---|---|---|---|
| D. 380,921 | 7/1997 | Ruscitti | 5/693 X |
| 1,841,410 | 1/1932 | Karr | 5/500 |
| 3,521,311 | 7/1970 | Cohen | 5/727 |
| 3,534,417 | 10/1970 | Boyles | 5/728 |
| 3,857,124 | 12/1974 | Hadley | 5/496 |
| 3,965,504 | 6/1976 | Ainsworth | 5/496 X |
| 4,304,018 | 12/1981 | McClam | 5/499 X |
| 4,424,600 | 1/1984 | Callaway | 5/500 X |
| 4,924,542 | 5/1990 | Yamaguchi | 5/693 |
| 4,955,095 | 9/1990 | Gerrick | 5/738 X |
| 5,035,017 | 7/1991 | Komuro | 5/693 |
| 5,042,099 | 8/1991 | Brenner et al. | 5/496 X |
| 5,092,010 | 3/1992 | Wong | 5/498 X |
| 5,117,519 | 6/1992 | Thomas | 5/728 X |
| 5,138,730 | 8/1992 | Masuda | 5/693 |
| 5,172,436 | 12/1992 | Masuda | 5/693 |
| 5,195,197 | 3/1993 | Gutierrez et al. | 5/906 X |
| 5,226,185 | 7/1993 | Guay et al. | 5/737 X |
| 5,475,881 | 12/1995 | Higgins et al. | 5/737 |
| 5,488,746 | 2/1996 | Hudson | 5/500 |
| 5,566,411 | 10/1996 | Eiler | 5/497 X |
| 5,655,241 | 8/1997 | Higgins et al. | 5/737 |
| 5,732,424 | 3/1998 | Bond | 5/498 X |

*Primary Examiner*—Terry Lee Melius
*Assistant Examiner*—Robert G. Santos

[57] ABSTRACT

The invention is concerned with a mattress jacket having an accessible and expandable compartment therein. The jacket consists of a side wall closely following the contour of the mattress on which it is placed. The bottom of the side wall is tucked under the mattress and secured there under. The compartment includes a bottom sheet that is resting on top of the upper surface of the mattress. The side wall includes a fold that captures a side edge of the of the bottom sheet. There is a further fold in an upper section of the side wall of the jacket that is secured to itself and represents an accordion fold that may expand or collapse as the compartment includes more or less of a cushioning material. There is a third fold secured by seaming in a further upper section of the side wall forming a planar surface confronting the bottom of a cover that may be separably affixed to the same. The thus created compartment can receive any kind of cushioning pads without having to remove the mattress cap from a mattress on which it is installed. The compartment sides lock the cushioning material in place while providing a smooth aligned balanced surface, even when the bed is flexed.

8 Claims, 6 Drawing Sheets

MATTRESS JACKET WITH AN ACCESSIBLE AND EXPANDABLE COMPARTMENT

BACKGROUND OF THE INVENTION

The present invention is concerned with providing improved ergonomic sleeping surfaces in the prone and flex position which may be applied to household mattresses or to hospital or nursing home mattresses. Many ergonomic surface adaptations are known that are applied to regular mattresses and are kept in their respective positions by so-called contour or fitted sheets that cover the mattress top surface, the side surfaces and continue under the bottom surface and are kept in place by either pull cords or elastic edges. Many of the ergonomic adaptations involve pads that are being placed over the top of the mattress such as regular foam pads or specialty pads, that is, MicroDown "TM" which is distributed by CONCEPT DEVELOPMENT GROUP of IIC. Other pads include compartments that are filled with air such as the PRODIGY mattress system which is distributed by CROWN Therapeutics, Inc. Other pads are known that are therapeutically beneficial such as the gel pads. One such gel pad is known under the TM of "ACS Comfort Gel +2". Another One-Piece gel mattress overlay is known under the TM of Sierra III which is placed over any existing mattress and is distributed by Mason Medical Products. Any of the above named ergonomic pads are applied to the top of an existing mattress, that is, as an overlay and are kept in place by a regular fitted sheet flaps and/or a fitted sheet especially designed for that purpose. Another ergonomic surface cushion is known under the trademark Skil-Care Cushion which is constructed of an outer launderable cover followed by an incontinent proof inner cover and a pressure reducing gel layer and a pliant foam for added comfort. This cushion has safety straps ostensibly to keep the cushion in place wherever it is to be used. There are other ergonomic pads known under the technical concept of alternating pressure air pads. One such pad is known under the TM of GENADYNE Gen Air "8000 Plus".

This pad is applied over the top of a mattress and is held in place by a fitted sheet or cover. This pad is distributed by the GENADYNE Biotechnologies. Another alternating pressure air pad is known under the TM of Excel 8000. This pad as well as all previously mentioned pads are also kept in place by a fitted sheet or cover. It is distributed by the Best Care Corporation. Still another alternating pressure system is distributed by GAYMAR Industries, Inc. under the system identifiers APP 3302I and 3312. The systems are fastened to existing mattresses with end flaps.

OBJECTS OF THE INVENTION

An object of the invention is to create a mattress top that has an accessible compartment on its top that can accommodate all of the above mentioned pads either singly or in combination. The compartment has an integral bottom resting on the top surface of the mattress which continues down the sides of the mattress and under the same just like a fitted sheet. The compartment is also expandable or collapsible in order to accommodate pads having different thicknesses or to accommodate several pads at the same time. The purpose of the mattress jacket is to enhance, that is, to match a mattressess's features with the needs of an individual and/or to luxuriate any existing mattress. The pad is made of a size to fit mattresses of any size presently available. That includes single, double, queen and king size mattresses and also mattresses made to customer's specifications. Because of the fact that the compartment of the mattress jacket is readily accessible the comfort or the ergonomic characteristic of the mattress can readily be changed without having to remove the jacket. For example, a king sized bed for two people can accommodate half of a stiff pad or cushion while the other half could consist of a softer cushion or pad, all according to the comfort and wishes of the individuals involved. This simply changes the characteristics of the sleeping surfaces. The compartment can be closed off by a removable cover that is separably being fastened to or around a top edge of the compartment wall. The mattress jacket could also be adapted for an adjustable hospital bed wherein sections of the bed and the mattress articulate relative to each other. To accommodate the mattress jacket and to make it adaptable to an articulating mattress, it is contemplated that elastic sections be incorporated into the side wall of the cap at the points where the articulation occurs to prevent the side wall fabric either from stretching or from buckling. With other words, the side wall fabric is self-adjusting.

BRIEF DESCRIPTION OF THE DRAWINGS

FIG. 2 is an overview of an adjustable bed in different views.

DETAILED DESCRIPTION OF THE DRAWINGS

Figure 1:
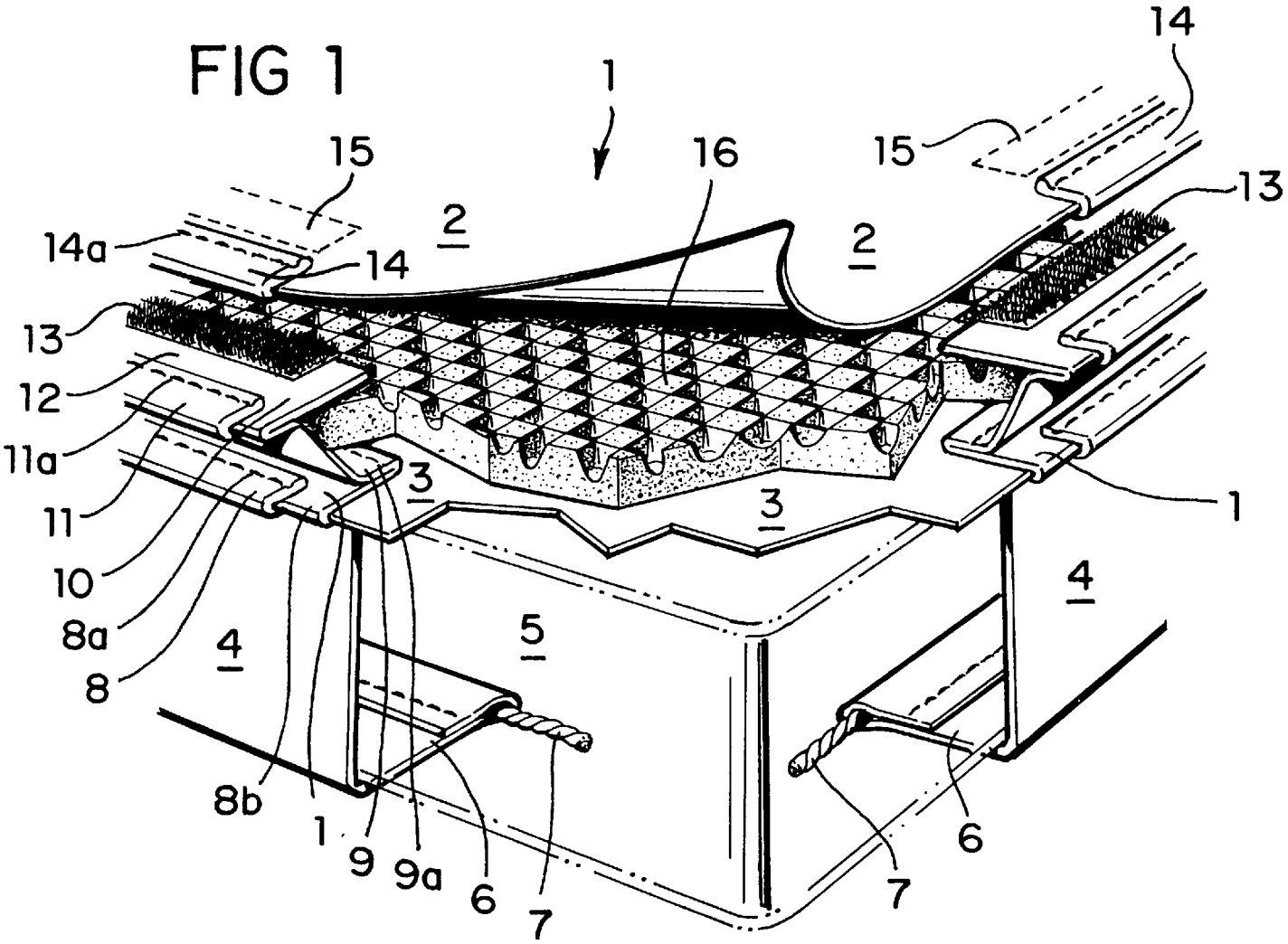
FIG. 1 is a perspective view of the mattress cap installed over a regular mattress with parts broken away to reveal the inside construction.

FIG. 1 in a perspective view, shows the overall construction of the mattress cap 1 as it is installed over a mattress 5. Numeral 2 represents the removable top cover of the expandable compartment. The compartment has a bottom fabric 3 that overlies the top of the mattress and is in contact therewith. The mattress cap 1 further consists of side walls 4 that lie against the side walls of the mattress 5. The side walls 4 continue and are tucked under the bottom of the mattress as at 6 which is a well known feature in fitted sheets. The tucked under edges 6 are securely held in place by the pull cord 7. This pull cord 7 could also be an elastic cord in a pocket, an elastic edge, an elastic band sewn to the edge, snaps, hooks etc. There is a first binding 8 which is sewn by stitches 8*a* around a fold 8*b* of the side wall 4 and then sewn to the edge of the bottom sheet 3. The fold 8*b* thereby captures the edge of the bottom sheet. As the side wall 4 continues upwardly, a second fold 9 is formed and is secured as a fold by stitches 9*a*. Still a third fold 10 is formed in the upper section of the side wall 4 and this fold 10 is secured by a binding 11 and then secured by stitching 11*a*. The fold 12, after it is secured by stitching, creates an upper planar edge 12 on the side wall. To this planar edge 10 the female part 13 of a hook and loop fastener is fastened which will be matched by the male part 15 of a hook and loop fastener 15 which is fastened to the underside of cover 2. The purpose of these female and male parts is to secure the cover to the upper planar edge 12 of side wall 4 to thereby completely close the compartment of the mattress cap. Instead of using hook and loop fasteners, a zipper could be used for that purpose or snaps or hooks. The edge of the cover 2 itself is finished with a binding 14 being stitched to the cover by stitches 14*a*. There are certain types of synthetic materials that lend themselves quite well to an ultrasonic stitching or seaming process by which a bonding takes place. Within the open compartment a cushion pad 16 is enclosed. As will be described later, many different types of pads may be received therein and having different thicknesses. That is why the compartment has been made expandable. That is why the fold 9 in the upper section of the side wall has been included. The fold 9 may be considered as an accordion fold which can expand and collapse. Many different fabrics may used in the construction of the cap 1 and the cover 2 and many types of cushions 16 may be used as will be described below.

JACKET

Woven fabrics non-woven fabric, quilted fabric, damask: made from natural or synthetic materials.

COVER

Woven fabric, non-woven fabric, laminated fabric, quilted fabric: made from natural or synthetic materials.

CUSHION

Foam, water, gel, air, silicone, sand or combinations thereof.

FIG. 2 is an overall illustration of an adjustable bed such as is used in hospitals or in the home.

Figure 2A:
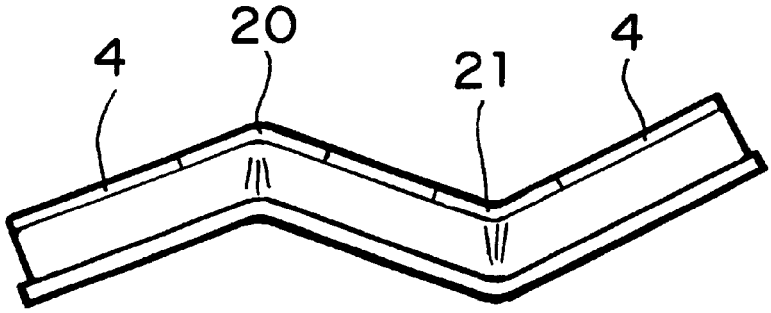
FIG. 2*a* is a side view of an adjustable bed with a mattress cap thereon.

FIG. 2*a* shows the bed in an articulated position. 20 and 21 indicate elastic sections that are inserted in the expandable side wall 4 of the jacket. The elastic sections 20 and 21 will help stabilize the cap when the bed is in an articulated position to prevent the side wall material from buckling and crowding itself.

Figure 2B:
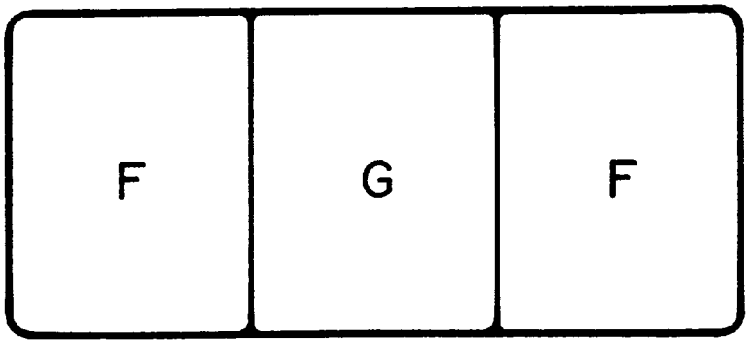
FIG. 2*b* is a top view of different cushions arranged within the compartment.

FIG. 2*b* shows a top view of the articulated mattress jacket of FIG. 2 showing three different cushions arranged in a row, particularly arranged where the articulations of the bed occur. This is a customized arrangement designed for the needs of a patient. The letters F indicate foam cushions while the letter G represents a cushion containing gel material. The use of gel in cushions is well known, especially in hospital beds where bedridden patients require special care to eliminate the potential of decubitus ulcers.

Figure 2C:
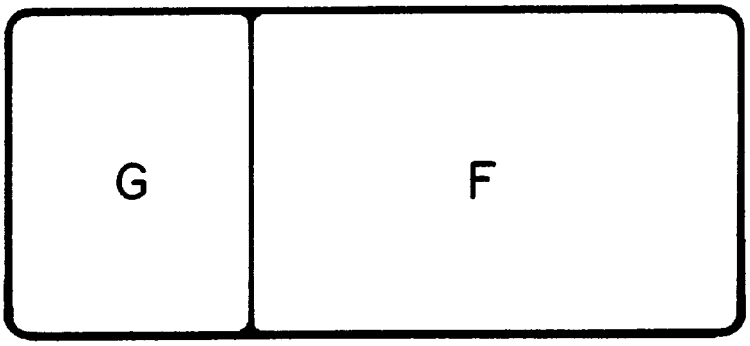
FIG. 2*c* is another top view of different cushions arranged within the compartment.

FIG. 2*c* is a similar arrangement as is shown in FIG. 2*b* but it shows a foam F cushion in combination with a gel G cushion, however in different sizes and different placements.

Figure 2D:
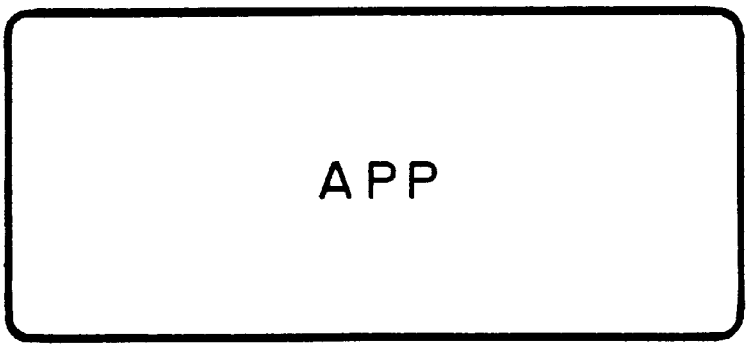
FIG. 2*d* is still another view of a cushion arranged within the compartment.

FIG. 2*d* shows a different cushion altogether in that APP indicates this is an alternating pressure air pad which is readily available on the market. However in the inventor's mattress jacket having an accessible and expandable compartment with its separable cover, it is so easy to make changes of cushions within the compartment without having to remove the jacket from a mattress.

Figure 3:
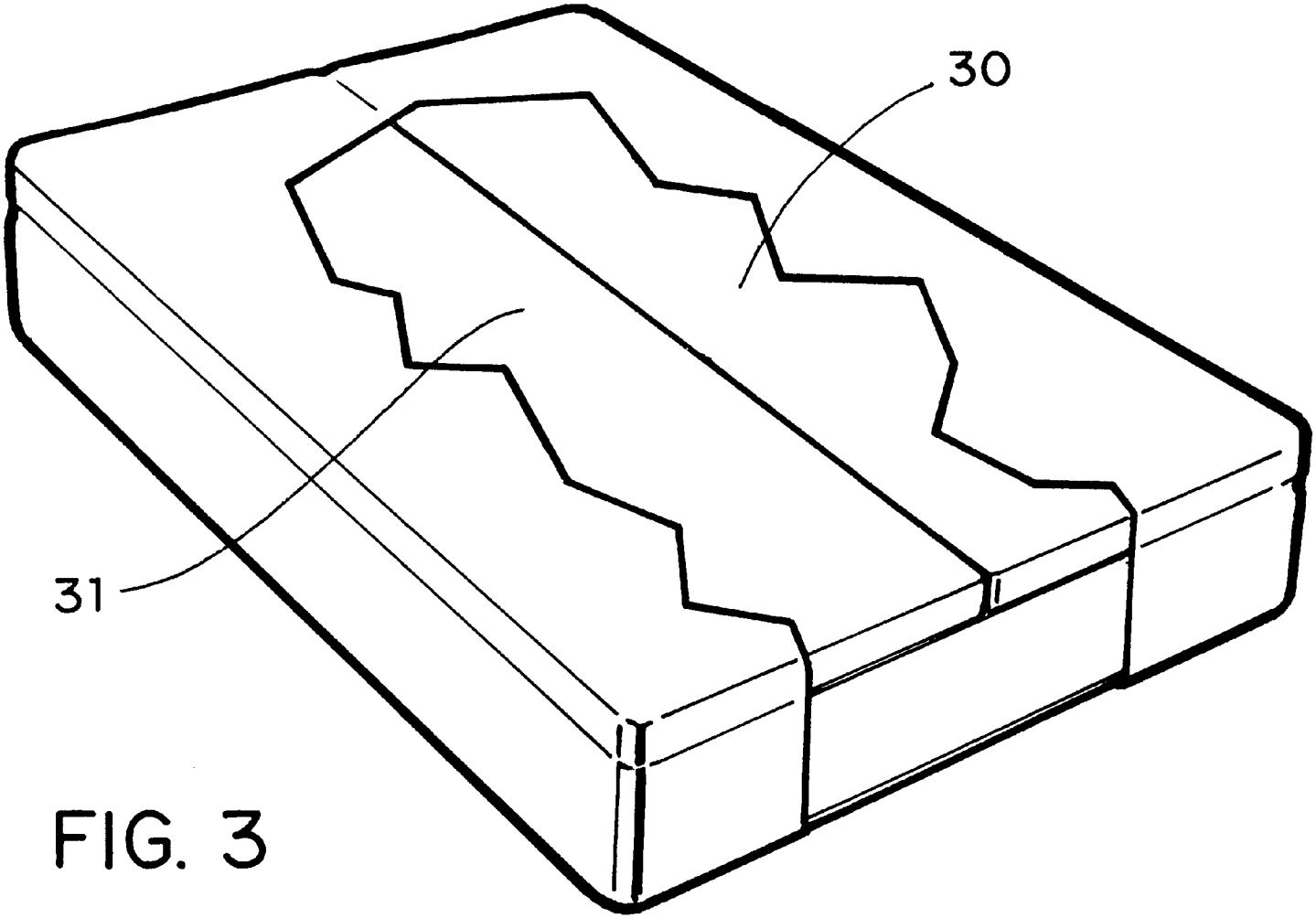
FIG. 3 is a top view of a flat mattress having differently arranged cushions.

FIG. 3 is a top view of a regular flat mattress having two half cushions 30 and 31 placed side by side within the expandable compartment of the mattress jacket. However each of the halves is a different type of cushion. The regularly sized mattress could be a double mattress, a queen sized mattress or a king sized mattress or a custom sized mattress. In any event the mattress jacket with the expandable compartment can be made to fit any sized mattress.

Figure 4:
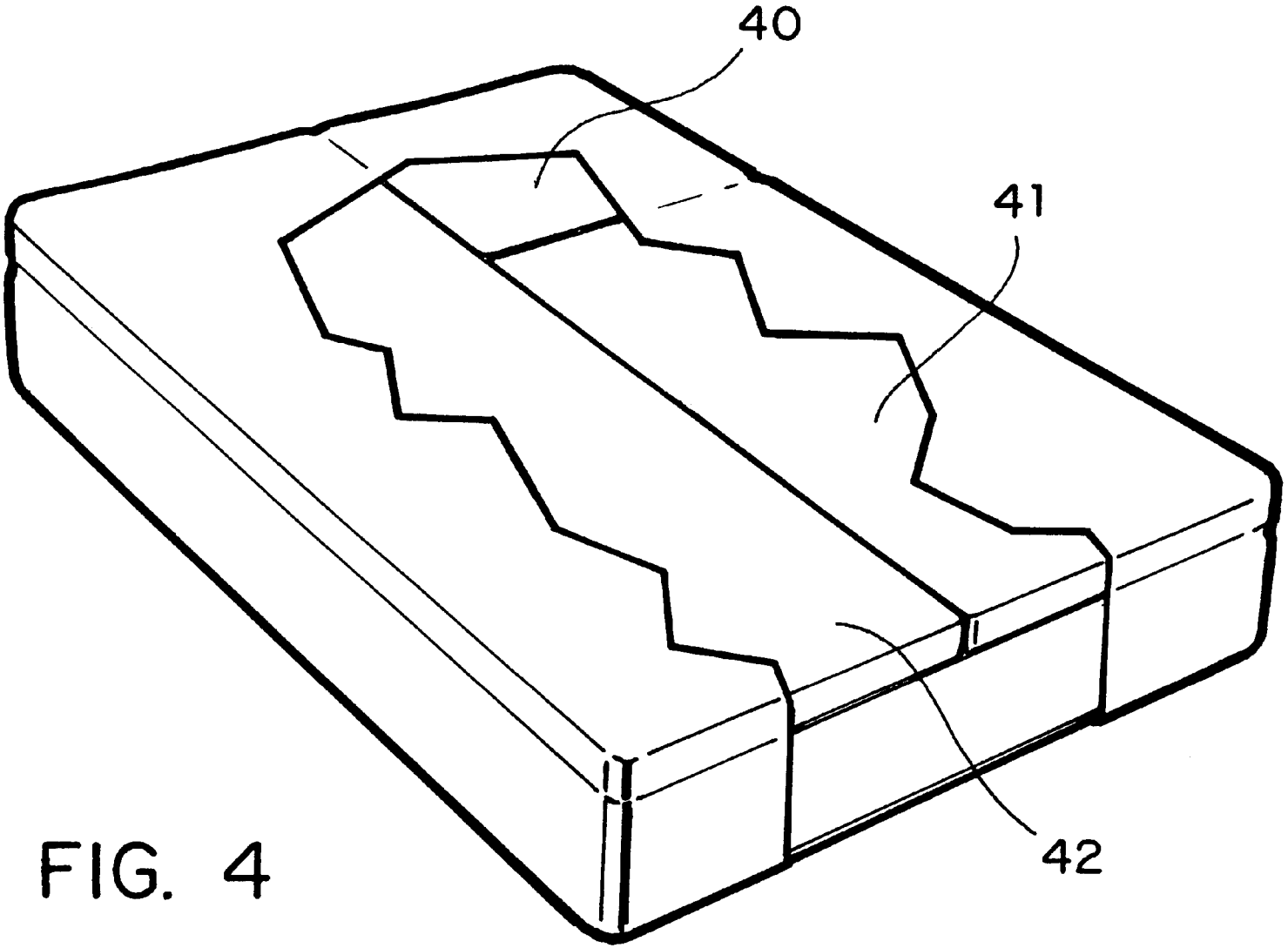
FIG. 4 is still another top view of a flat mattress with different cushions thereon.

FIG. 4 is still another top view of a regular flat mattress having three cushions placed in different areas of the compartment wherein 40 represents a gel cushion, 41 is foam cushion that is firm, while 42 is a foam cushion that is soft. This arrangement is designed for two persons using the same mattress but requiring different comfort levels and needs. Again, with the mattress cap having an expandable compartment, it is so easy to change the cushion arrangement at any time that the comfort needs change with the same persons or with different persons.

Figure 5:
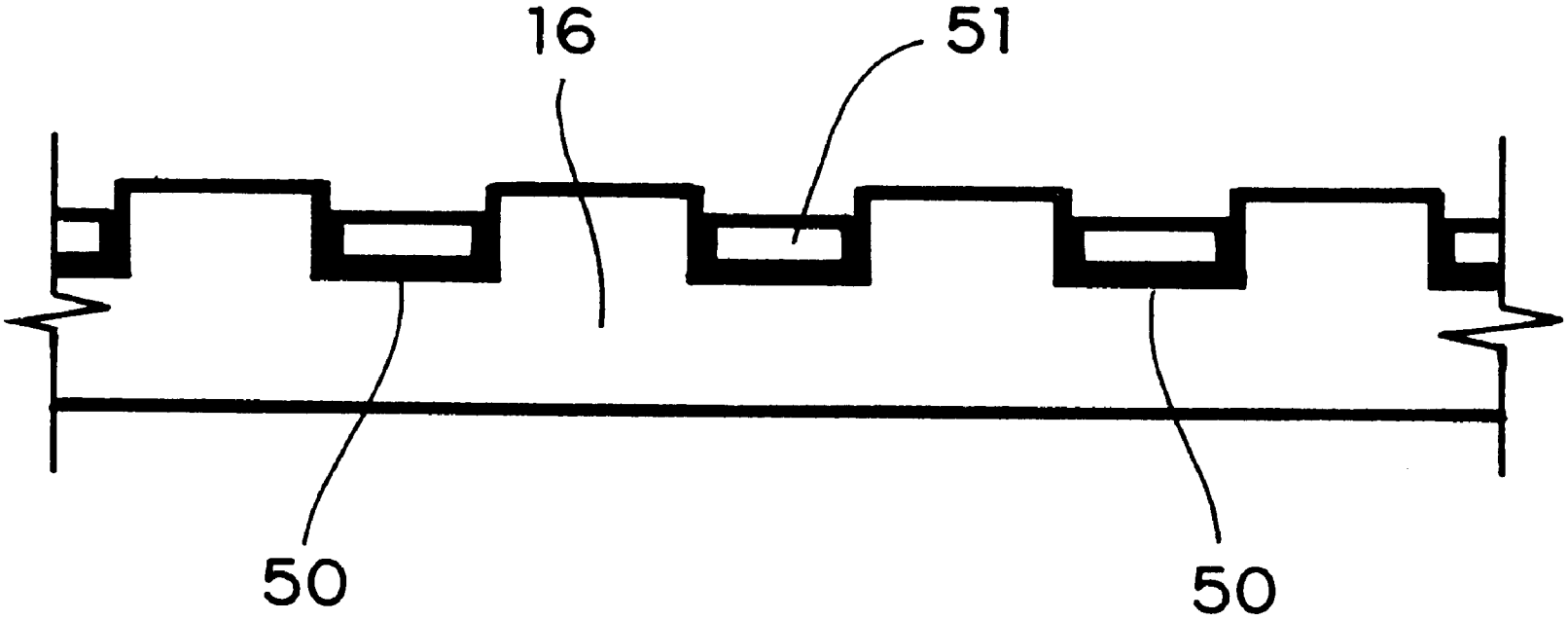
FIG. 5 is a side view of a convoluted foam cushion.

FIG. 5 is a side view of a MicroDown "TM" cushion having flat convolutions 50 and other depressions on its top surface. Within the convolutions 50 and other depressions there are placed magnetic elements 51 which may consists of magnetic strips or magnetic discs. Magnets create magnetic fields and a magnetic field placed closely to the body attracts and repels charged particles in the blood, creating movement and heat. This process causes blood vessels to dilate, increasing circulation, thus accelerating the natural healing process.

Figure 6:
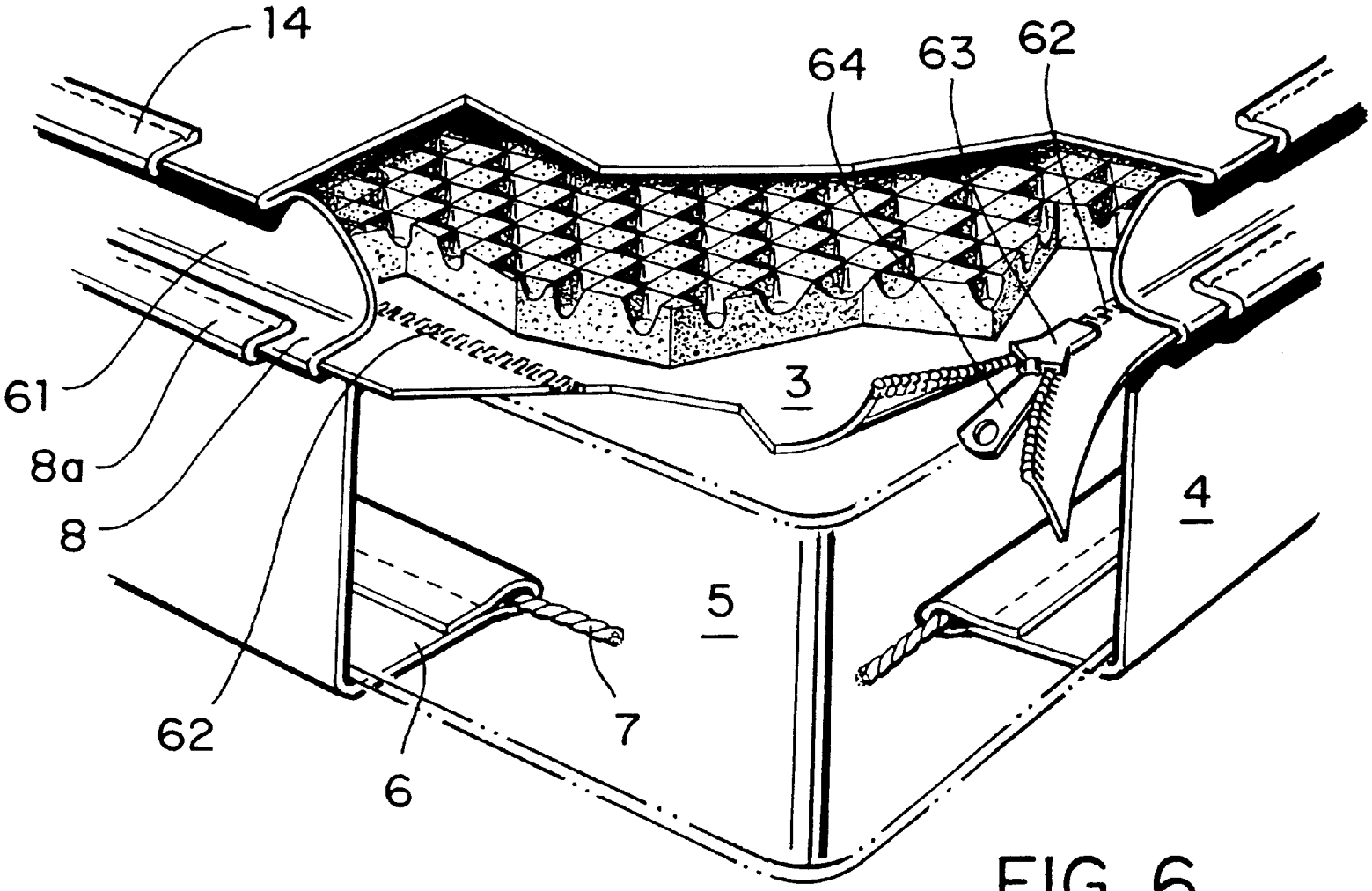
FIG. 6 shows a different way of gaining access to the compartment.

FIG. 6 shows a different way of gaining access to the expandable compartment. In this construction the top cover 2 is fastened to the top of the upper section of the side wall 4. This creates a top pillow 61 fold which is well known in more luxurious mattresses. In order to gain access to the inside of the compartment, a zipper 62 has been installed in the bottom sheet 3 close to its peripheral edge. The slider 63 with its tab 64 is accessible from the underside of the bottom sheet 3. That means that the compartment is accessible from its underside in order to place cushions or pads therein. In operation, the mattress jacket is placed up-side-down, the zipper 62 is either partially or fully opened and the respective cushion or cushions are placed inside the compartment to thereby fill the same to a more or less extent including the expandable pillow fold 61. After closing the zipper, the mattress jacket is now installed over its respective mattress.

What we claim is:

1. A mattress jacket for attachment to a mattress, said mattress jacket having an accessible and expandable compartment comprising a side wall adapted to be wall closely contacting all side walls of said mattress on which it is installed, said side wall of said jacket is adapted to be tucked under a bottom wall of said mattress and having means for tightly securing the same under said mattress, said expandable compartment further having a bottom sheet of fabric adapted to be being in close contact with a top surface of said mattress, said side wall having a first fold therein capturing an edge of said bottom sheet and means for securing said fold to said edge of said bottom sheet, a second fold in an upper section of said side wall being secured to itself by sewn seams, said second fold representing an accordion fold that can expand or collapse, a third fold in a further upper section of said side wall, said third fold having means for securing said fold and forming an upper planar edge, a cover for closing the thus created compartment, means for separably attaching said cover to said further upper section of said side wall.

2. The mattress jacket of claim 1 including cushion means placed within said compartment.

3. The mattress jacket of claim 1 wherein said first and said third fold include an edge binding in said means for securing.

4. The mattress jacket of claim 1 wherein said cover includes a seam binding around its edges.

5. The mattress jacket of claim 2 wherein magnetic elements are placed within said cushion means.

6. A mattress jacket for attachment to a mattress, said mattress jacket having an accessible and expandable compartment comprising a side wall adapted to be closely contacting all side walls of said mattress on which it is installed, said side wall of said jacket is adapted to be tucked under a bottom wall of said mattress and having means for tightly securing the same under said mattress, said expandable compartment further having a bottom sheet of fabric adapted to be being in close contact with a top surface of said mattress, said side wall having a fold therein capturing an edge of said bottom sheet and means for securing said fold to said edge of said bottom sheet, a second fold in an upper section of said side wall representing an accordion fold that can expand and collapse, a cover secured to an upper edge of said upper section to thereby form a compartment, a separable fastener installed close to a peripheral edge of said bottom sheet allowing access to the interior of said compartment.

7. The mattress jacket of claim 1 wherein the means for securing comprises sewn seams.

8. The mattress jacket of claim 6 wherein the means for securing comprises sewn seams.

* * * * *